United States Patent [19]

Nelson

[11] 4,010,597

[45] Mar. 8, 1977

[54] APPARATUS FOR CLOSING AND SEALING TWO-PIECE SLOTTED CONTAINERS

[75] Inventor: Iver L. Nelson, Minneapolis, Minn.

[73] Assignee: Hoerner Waldorf Corporation, St. Paul, Minn.

[22] Filed: July 1, 1976

[21] Appl. No.: 701,983

[52] U.S. Cl. ..... 53/374; 53/383; 53/387

[51] Int. Cl.² ..... B65B 7/20; B65B 51/02

[58] Field of Search ..... 53/374, 387, 383, 169

[56] References Cited

UNITED STATES PATENTS

| | | | |
|---|---|---|---|
| 3,038,284 | 6/1962 | Kaestner | 53/383 |
| 3,587,209 | 6/1971 | Arentz | 53/374 |

*Primary Examiner*—Travis S. McGehee
*Attorney, Agent, or Firm*—Jerry F. Best

[57] ABSTRACT

Apparatus for closing and gluing containers which are of the type assembled from two pieces including a slotted tray with an outer sleeve which telescopes over the assembled tray and which has top flaps foldable into position as the top of the container. The tray is assembled and the sleeve is placed thereon prior to filling and the filled container is then directed into the apparatus which raises the outer sleeve to allow adhesive to be applied to the tray and at the same time allow the flaps to be glued and folded into position, the outer sleeve subsequently being pressed into position and held in that configuration until the adhesive can set, the finished container having adhesive holding the sleeve to the tray and the outer closure flaps sealed.

4 Claims, 21 Drawing Figures

APPARATUS FOR CLOSING AND SEALING TWO-PIECE SLOTTED CONTAINERS

BACKGROUND OF THE INVENTION

1. Field of the Invention

This disclosure relates generally to apparatus for closing and sealing erected cartons which have been filled, and more particularly to apparatus which is adapted to provide an adhesive seal between a half slotted tray and its outer telescoping sleeve while simultaneously closing and sealing the top flaps for the container which are attached to the top edges of the sleeve.

2. Description of the Prior Art

The container which is shown in the present disclosure is one which is loosely described as a half slotted tray. In point of fact, it is a folded tray with double thickness ends or side walls, depending upon the positioning of the flaps, which is used in conjunction with a telescoping outer sleeve which is half slotted, meaning that the slotted closure flaps, which are for the top of the container, are positioned on only one side of the blank. This type of container is used in the meat packing industry since it is quite strong and therefore suitable to contain the heavy cuts of meat and withstand rough handling during shipment and storage. Traditionally, this type of container has been assembled with the top flaps left open and then strapped or banded after being filled. There is a need for automatic equipment which will close the container in such a way that bulging is reduced to a minimum and also in such a way that the banding is eliminated to improve its resistance to pilferage.

It should be noted that U.S. Pat. No. 3,587,209 to Arent shows closing of a telescope carton, but in that case the sleeve is retained by tabs moved out from the sides of the tray.

SUMMARY OF THE INVENTION

Apparatus for closing and sealing a telescoping container of the type described including a conveyor along which the filled, open top containers are advanced with means for raising the sleeve in a telescoping manner to allow adhesive to be applied to the sides of the tray and means to simultaneously glue and fold the top flaps with subsequent reorientation of the sleeve down over the glued areas of the tray, and means to hold the respective portions of the container in position while the adhesive sets.

DETAILED DESCRIPTION OF THE PREFERRED EMBODIMENT

Figure 1:
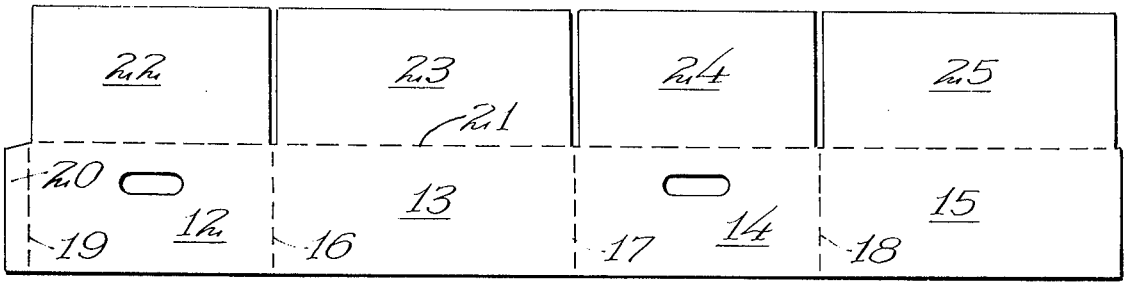
FIG. 1 is a plan view of a blank adapted to be erected into a sleeve for use as part of a container to be closed by the equipment of the present invention.
Figure 2:
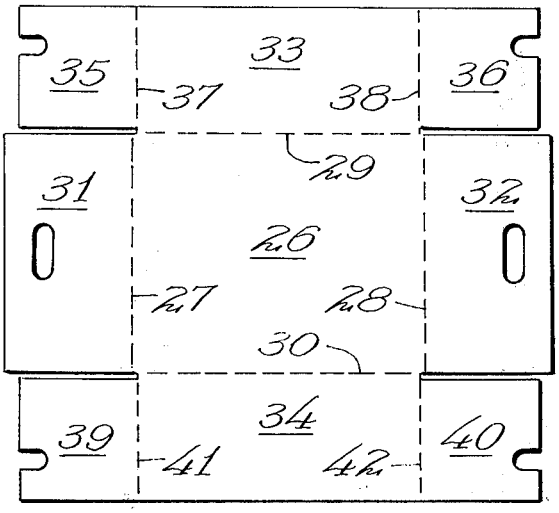
FIG. 2 is a plan view of a blank for the tray which, together with the sleeve of FIG. 1, are assembled into a container and closed by the apparatus of the present invention.
Figure 3:
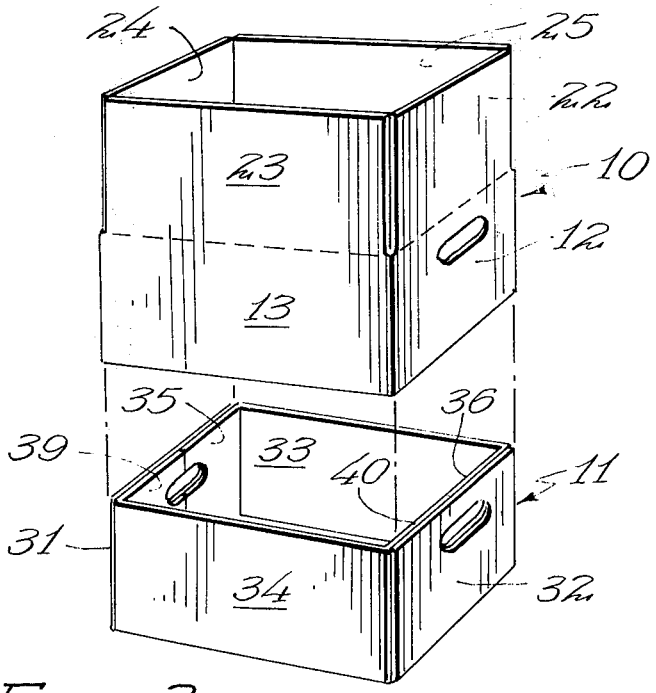
FIG. 3 is a perspective view illustrating the telescopic relationship between a sleeve such as formed from a blank illustrated in FIG. 1 and a tray formed from a blank such as that illustrated in FIG. 2.

The container which is adapted for use with the present apparatus is a two-piece style shown in FIGS. 1 through 3 which includes an outer telescoping sleeve 10 which slides down over an assembled rectangular tray 11. The blank for forming the outer sleeve 10 is seen best in FIG. 1 and is substantially rectangular in shape with four rectangular side wall panels 12, 13, 14 and 15 which are hingedly connected to one another along vertically extending fold lines 16, 17 and 18. Attached along the fold line 19 at one edge of the blank is a manufacturer's glue flap 20. The top edge of the blank for the outer sleeve 10 is defined by a horizontal fold line 21 along which are attached closure flaps 22, 23, 24 and 25.

The tray is formed from a substantially rectangular blank of corrugated paperboard having a rectangular bottom panel 26 which is defined by vertical fold lines 27 and 28 on its lateral sides and by horizontal fold lines 29 and 30 which define the top and bottom edges thereof. End wall panels 31 and 32 are connected along the lateral edges of the bottom panel 26 along fold lines 27 and 28, respectively. Side wall panels 33 and 34 are connected to the bottom panel 26 along top and bottom fold lines 29 and 30, respectively. While the particular configuration of the bottom tray is variable, the particular one illustrated has reinforcing end wall sections 35 and 36 attached to either lateral edge of the side wall 33 by vertical fold lines 37 and 38 with similar panels attached to either lateral edge of the side wall 34 identified as 39 and 40 and are attached along vertical fold lines 41 and 42. It can be seen in FIG. 3 that the reinforcing panels on either end of the tray 11 are folded to lie inside of the end wall panels 31 and 32 to give a double thickness end wall and that the sleeve 10 fits snugly over the perimeter surfaces of the tray 11 so that the side walls of the container also are double thickness.

Figure 4:
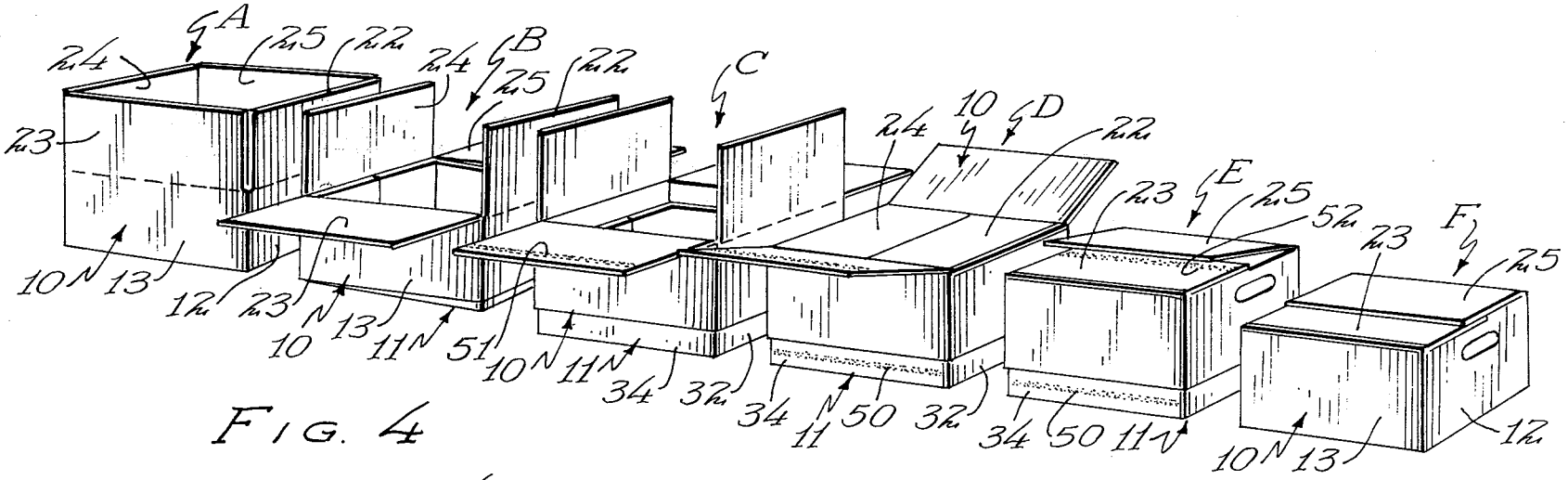
FIG. 4 is a perspective view illustrating the progression of a container which has been assembled and filled through the various stages of the operations which are performed by the apparatus of the present invention, the figure intended to represent the progression of movement of a single carton rather than the spacing of successive cartons as they are moved through the equipment.

The sequential operations which are performed by the apparatus in closing and sealing the carton are described best in connection with FIG. 4, and it can be seen that as the carton in position A advances into the apparatus the tray 11 and sleeve 10 are assembled and have been filled with meat or with whatever product is to be placed therein and the flaps 22 through 25 are left open. As the container advances through the equipment the major flaps 23 and 25 are folded into a horizontal position (B) and are used to support the sleeve 10 while the tray 11 is lowered, (C) thereby telescoping the sleeve and tray in such a way as to expose a portion of the bottom of the side walls of the tray so that adhesive may be applied along that side. The minor flaps 22 and 24 are automatically folded down (D) while the sleeve 10 is elevated and the major flaps are then folded into overlapping position (E) with adhesive being first applied to the underlying flap with the final step being to realign the sleeve 10 and tray 11 into full telescoped position and apply pressure to both the top and sides in order to allow the adhesive to set while the box is in its proper configuration (F). The relationship of the tray 11 and sleeve 10 to the various mechanical components of the apparatus is described in more detail below.

Overall Assembly Description

Figure 7:
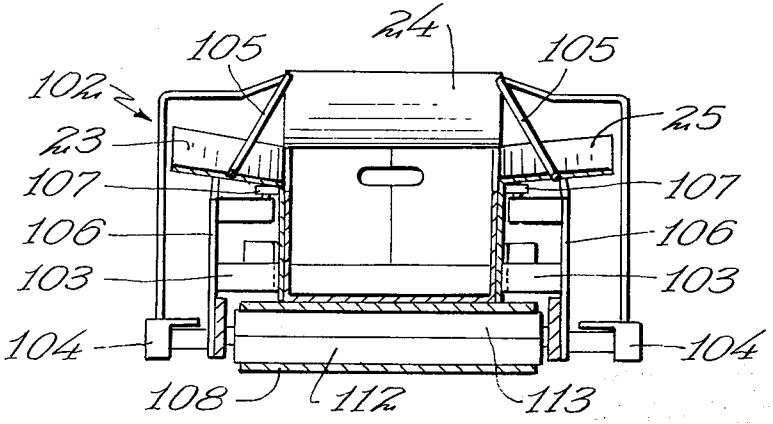
FIG. 7 is an elevation view of the leading end of a carton just starting into the charge end of the apparatus, which is on the left side of the FIGS. 5 and 6 and illustrates how the outwardly positioned flaps are moved into horizontal relationship prior to application of the adhesive.
Figure 5:
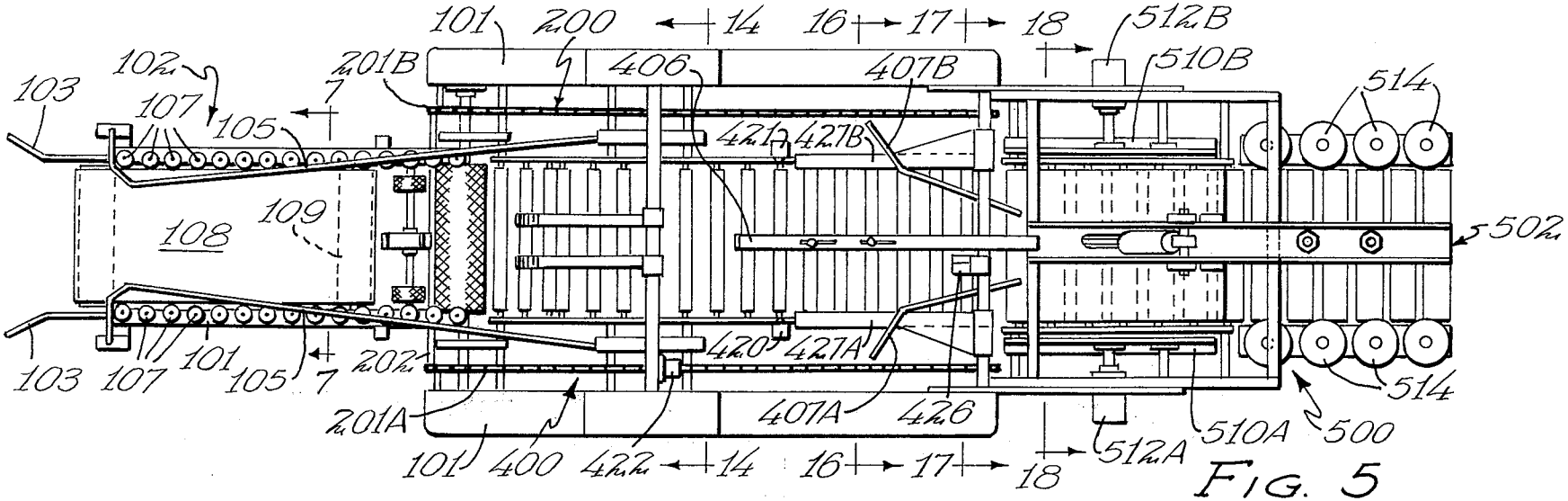
FIG. 5 is a top plan view of the apparatus of the subject invention.
Figure 6:
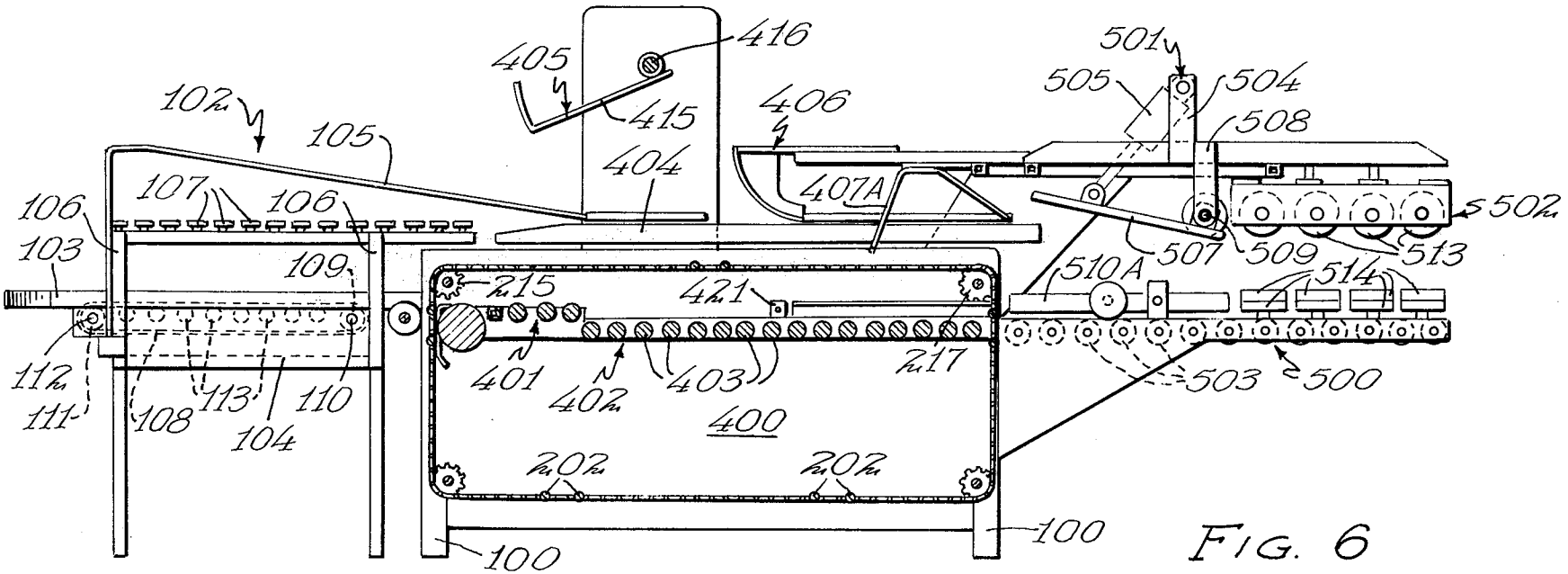
FIG. 6 is a side elevation view of the apparatus shown in FIG. 5, with certain portions of the supporting framework and drive assembly removed to better illustrate the working relationship between various key elements of the apparatus.

FIGS. 5 and 6 are plan and elevation views respectively of salient portions of the assembled apparatus which include vertical frame members 100 which in turn support a horizontal frame assembly 101 to which most of the apparatus is attached. The container moves upon and is supported by a roller conveyor which may be described as having four sections including an in-feed section 102 which is seen at the left of the figures and is in the particular embodiment shown covered by a belt 108 upon which the container is located as it is moved into the apparatus in the configuration shown by the carton designated as A in FIG. 4. The movement of the cartons into this section may be from a chute or from another conveyor not shown. As the cartons enter the apparatus there are horizontal alignment guides 103 which are attached to the angle iron framework 104 which supports the conveyor 108 and to which it is attached. Also supported by the framework 104 are cam rails or plows 105 which serve to engage the major flaps 23 and 25 and move them downwardly into horizontal position as the carton is moved into the apparatus on the conveyor 108. The final outwardly folded position is seen as the configuration in FIG. 4(B) and this action is also illustrated in FIG. 7 which is taken approximately through the apparatus at the section lines 7—7 of FIG. 5.

Additional framework members 106 are used as partial support for the guide rails 105 and also serve as support for a series of rollers 107 which are mounted on vertical axes and contact the sides of the carton directly below the fold lines 21 where the major flaps 23 and 25 are joined to the side walls 13 and 15 of the outer sleeve 10. This stabilizes the sleeve and assures a clean crease when the major flaps 23 and 25 are moved downwardly by the action of the guide rails 105 against the flaps as the carton is moved into the apparatus. The guide rollers 107 also serve to more closely align the carton for the later operations in the apparatus.

The in-feed conveyor section 102 consists of a belt 108 which is driven by the roller 109 which is supported in the framework 104 by a rotatable shaft 110. A similar roll 111 on a rotatable shaft 112 provides support for the opposite end of the endless belt 108. Smaller rolls 113 are spaced between the two rolls 109 and 111 and provide support for the belt 108. These rolls 113 are rotatably mounted in a framework 104. When the carton has moved through the in-feed section 102 the flaps are substantially in that position shown in configuration B of FIG. 4 and the movement of the carton is arrested by a gate mechanism to be described later which restrains the carton against the motion of the in-feed conveyor 102 until an opening in the conveyor means for advancing the cartons moves into position.

The remainder of the Apparatus includes a center section 400 in which the tray 11 and sleeve 10 are telescoped apart, the adhesive is applied to the various parts of the container, and the flaps are folded as illustrated in the steps C, D and E of FIG. 4. The section 400 includes an endless conveyor 200 to be described later which moves the carton assembly along a stepped conveyor which includes a short portion 401 at the same level as the in-feed conveyor 102 and the balance of the freely rotating conveyor 402 at a lower level shown by the rollers 403. Also in the section 400 is a pair of support rails 404 which provide support for the major flaps 23 and 25 as the carton is advanced through the mechanism. An automatic rotating flap closure arm means 405 is positioned above the conveyor 402. This central section 400 includes a closure means for the major flaps 23 and 25 in the nature of guide rails or cams which act against the flaps to fold them over into closed position and are designated as 407A and B.

The last major section of the apparatus is shown generally as 500 and includes a section of conveyor on which the container moves, and has compression members along the sides of the container to make certain that the outer sleeve is tightly pressed against the sides of the tray while the adhesive sets along with means for compressing the container in a vertical direction 501 which operates on a reciprocal manner. In addition, a compression roller section 502 is provided to hold the flaps tightly in position while the adhesive sets.

Conveyor Means For Advancing Cartons

Figure 9:
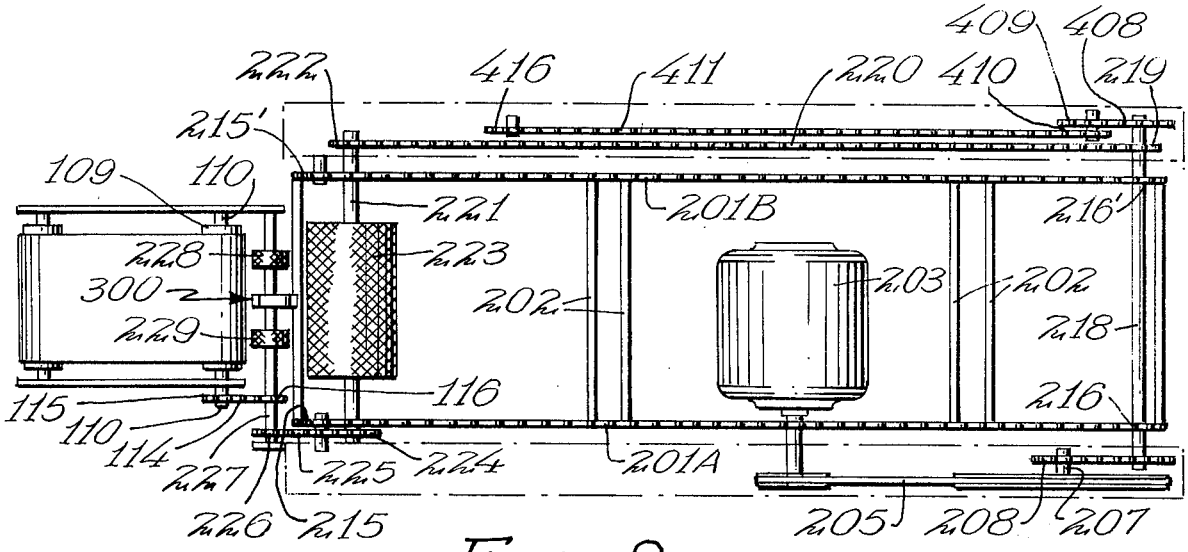
FIG. 9 is a top plan view in diagrammatic configuration of that portion of the apparatus shown in FIG. 5 which comprises the power train or drive assembly which advances the cartons through the apparatus during its operation.
Figure 10:
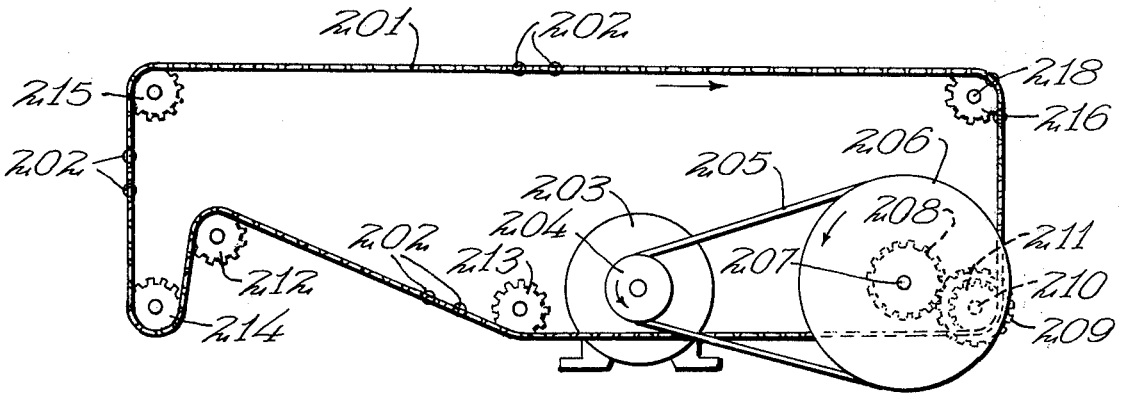
FIG. 10 is a side elevation view of the drive train apparatus shown in FIG. 9, again in diagrammatic style to illustrate the relationship between those parts comprising the drive train.
Figure 11:
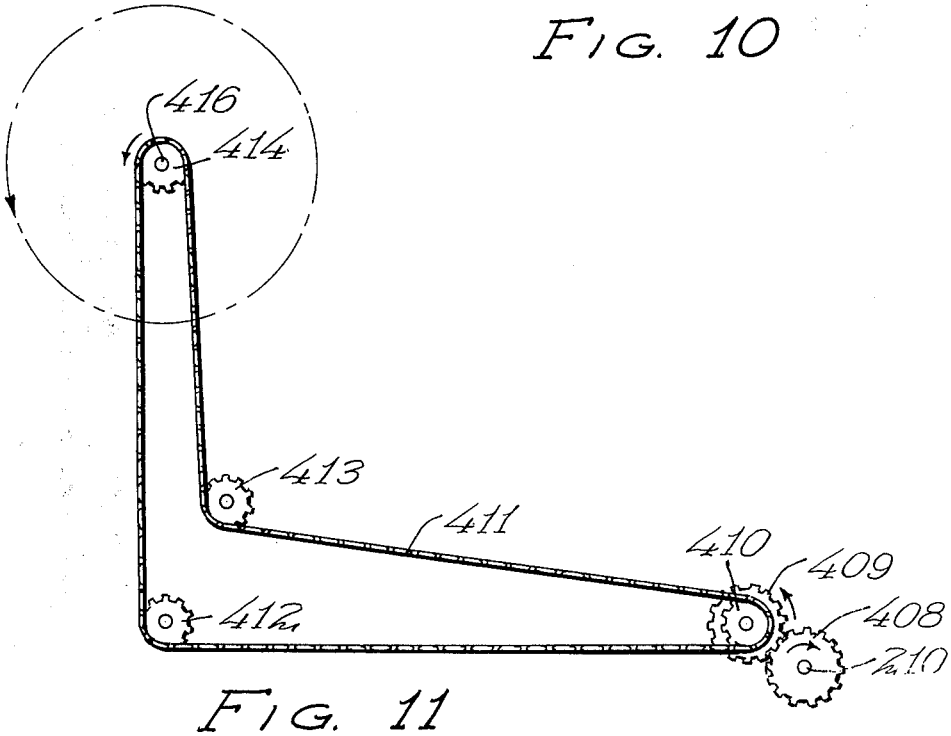
FIG. 11 is a side elevation view in diagrammatic style of the power train which operates the trailing minor flap fold arms which operates in synchronous manner with the drive train of FIG. 10.

It is necessary that the cartons be moved through the apparatus in an orderly manner with certain spacing requirements so that the individual functions may be carried out properly. Also it is likely that there will be intermittent or irregular spacing between sequential presented cartons as they are fed to the machine to be sealed and closed. To allow for this the apparatus has a endless conveyor means 200 which advances the cartons through the central section of the apparatus and when the cartons are placed on the in-feed conveyor in close proximity to one another they are allowed to move into this conveyor means 200 only at regular intervals to provide the appropriate spacing. FIGS. 9, 10 and 11 illustrate in plan view and schematically the relationship of the various parts of these conveyors. The conveyor means 200 for advancing the containers consists of a pair of drive chains 201A and 201B which travel in an endless path with the use of sprocket gears. Spaced along on these two chains and connected between the two chains at regular intervals are spacer bars which are mounted for rotation in the chains. These bars are shown as set apart pairs of rollers and designated as 202 in the drawings for clarity. The spacing between adjacent pairs of bars 202 assures the minimum clearance between adjacent containers in their progression through the apparatus. In the schematic diagram of FIG. 10 it may be seen that a power source in the form of an electric motor 203 which is attached to the framework 100 of the apparatus causes rotation of the pulley 204 in a counterclockwise rotation. This pulley in turn moves a belt 205 which extends around a larger pully 206 which similarly moves in a counter-clockwise direction. The pulley 206 is rotatably mounted on a shaft 207 to which is similarly mounted for rotation with the pulley 206 a geared wheel 208 which drives a second gear 209 in a clockwise direction about a shaft 210 to which it is rotatably mounted. On that shaft 210 is mounted a sprocket wheel 211 which is one of a series of sprocket wheels on which the chain 201 travels in a circuitous fashion. The particular embodiment shown illustrates the use of an idler sprocket 212 which serves to maintain proper tension in the system and this idler sprocket 212 works in conjunction with the sprocket 213 to properly direct the motion of the chain as well as provide sufficient total linear length of chain to provide an even number of container spacings. At the in-feed end of the system is a sprocket 214 and spaced above it a second sprocket 215 with the final sprocket being at the opposite or discharge end of the apparatus and labeled as 216.

As can be seen in FIG. 6, the two sprockets 215 and 216 are positioned slightly above the level of the roller conveyor upon which the cartons move so that the spacer bars 202 contact the ends of the carton. The drive chains 201A and B are driven in unison as seen in FIG. 9 by virtue of the shaft 210 extending across the width of the apparatus to a sprocket wheel (not shown) which drives the chain 201B about a similar circuit of sprocket wheels, those of which can be seen being numbered 215', and 216'. These drive chains and spacer bars are in continuous and circuitous motion so that as soon as a space is available a carton which is on the in-feed conveyor will be engaged and moved through the apparatus.

Restraining Apparatus

Figure 8:
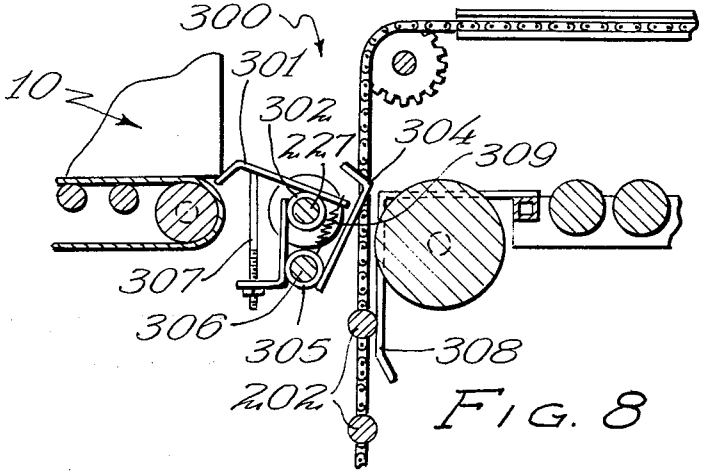
FIG. 8 is a side elevation view of a portion of the apparatus shown in FIGS. 5 and 6 and illustrates those components comprising the release mechanism which allows a container which has been placed on the in-feed conveyor to move into the apparatus and be engaged by the means for advancing the carton through the operative steps performed by the apparatus.

FIG. 8 is an enlarged view of the restraining apparatus which is incorporated at the end of the in-feed conveyor 102 and is shown generally as 300. The apparatus includes a gate arm 301 which is attached to a sleeve 302 which is capable of rotation about the shaft 227. A second arm 304 is connected to a sleeve 305 and capable of rotational movement about a shaft 306 when deflected by the rotatable spacer bars 202 which come into contact with the second arm 304 as they pass by that point. This deflection may be seen in FIG. 12 and serves to cause rotational movement of the sleeve 305 which has attached to it a connecting rod assembly 307 which extends to the gate arm 301 whereby the counter-clockwise movement of the arm 304, the sleeve 305, and the connecting rod 307 causes the restraining rod 301 to be rotated downwardly and allow a carton to pass on to the conveyor immediately behind the set of spacer bars 202 which trip the mechanism 300 and which will be the spacer bar contacting the leading edge of the carton as it moves through the apparatus.

In the operation of the restraining mechanism 300, the guide rail 308 serves to assure that the rollers on the spacer bars 202 will be in proper alignment for contacting the deflector bar 304, and a spring 309 is connected between the sleeve 305 and the end of the arm 301 opposite the infeed conveyor to hold the arm 301 up in the path of the containers to stop them when the second arm 304 is not deflected by the passing conveyor bar 202.

Center Section

As previously mentioned, it is in the center section 400 that the gluing and folding actually takes place. As seen best in FIG. 12, the carton, with the major flaps 23 and 25 outwardly folded as a result of interaction with the guide rails 105, is moved into the center section 400 when the restraining apparatus 300 is tripped by the passing of the roller bars 202 on the chains 201A and 201B, and is moved onto the higher conveyor section 401. This movement is accomplished as seen in FIG. 10 since the drive chains 201A and 201B, when turning the sprocket wheel 215, coincidentally are moving in a clockwise direction. The drive shaft 210 and sprocket 211 which drives the chains 201A and 201B and in turn rotates the sprocket 216 clockwise rotates the shaft to which sprocket 216 is attached labeled 218. As seen best in FIG. 9, a sprocket 219 is attached to the end of the shaft 218 outwardly from the sprocket wheel 217 which turns a drive chain 220 extending to the opposite end of the apparatus. This chain 220 rotates a shaft 221 to which is attached a geared wheel 222 and a large knurled roller 223. The opposite end of the shaft 221 has affixed thereto a sprocket wheel 224 which, in connection with a chain 225 and another sprocket wheel 226 rotates the shaft 227 to which is attached two smaller knurled rollers 228 and 229. The purpose of these knurled rollers is to engage the bottom surface of the tray 11 and insure that it is moved into position on the upper conveyor 401 as seen in FIG. 12 so that it will be fully aligned and in position when the set of roller bars 202 move upwardly past the bottom edge of the container and move around the sprocket wheel 215 to move along the length of the center portion 400 of the apparatus.

It should be noted in FIG. 9 that the in-feed conveyor is driven by a sprocket wheel 115 attached at the end of the shaft 110 which is driven by a chain 114 connecting that sprocket wheel 115 with a sprocket wheel 116 attached to the shaft 227. Maintaining the diameter of the roll 109 and the knurled rollers 228 and 229 at uniform radius along with similar sized sprockets insures that the linear speed of the carton coming off the in-feed conveyor 102 onto the knurled rollers is constant.

Figure 12:
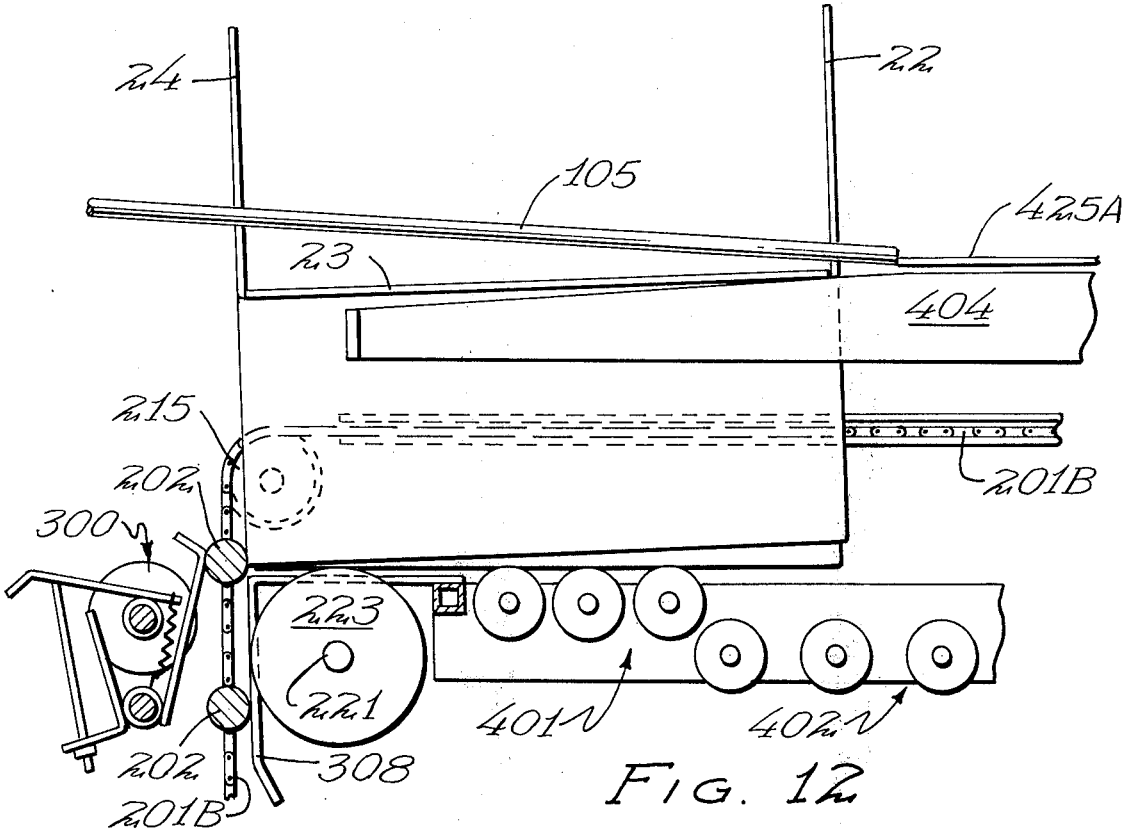
FIG. 12 is a side elevation view of a portion of the apparatus shown in FIGS. 5 and 6 illustrating how the outer sleeve is raised by cam rails as the container is advanced into the mechanism by contacting the outer folded major flaps.
Figure 13:
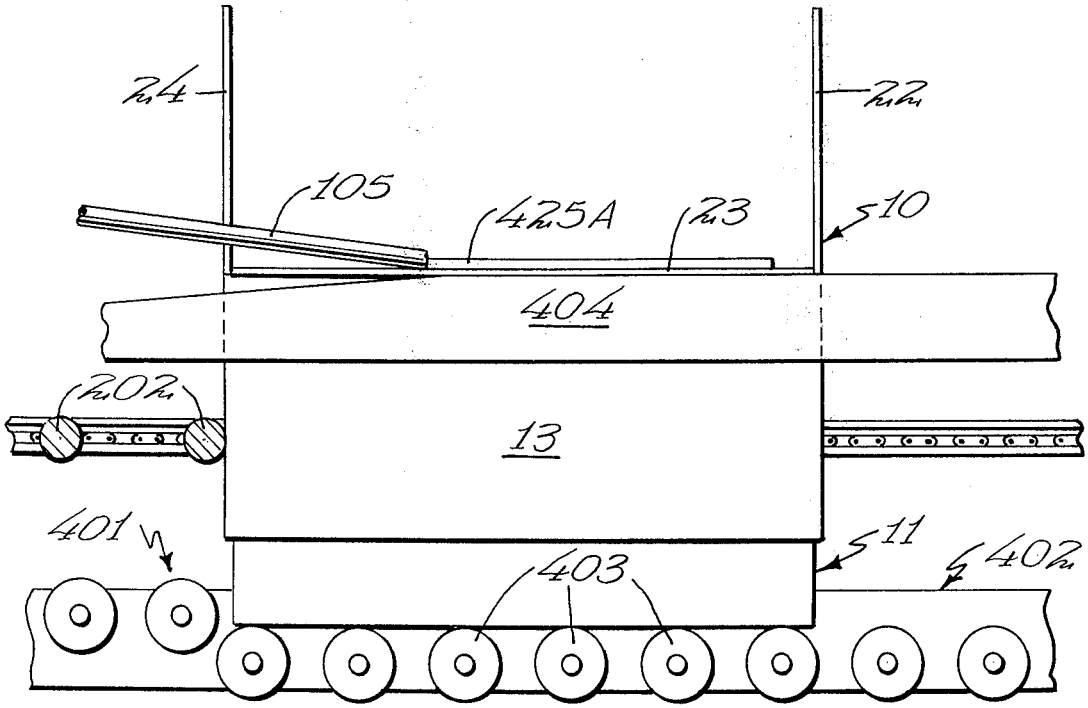
FIG. 13 illustrates the container shown in FIG. 12 at a subsequent stage in the apparatus and illustrates how the sleeve and tray are further separated by an arrangement of stepped-down rollers with the major flaps being held in horizontal position.

The major flaps 23 and 25 are in horizontal position as the carton enters the center section 400 as seen best in FIG. 12. They are in that position having been moved downwardly as the carton passed beneath the guide rails 105. The bottom edge of the major flaps 23 and 25 are then engaged by a second set of guide rails 404, the end of which may be seen in FIG. 12, which serve to hold the flaps 23 and 25 and sleeve 10 in the same vertical plane as the container is advanced along the conveyor to the step between the higher conveyor section 401 and the main section 402, seen best in FIG. 13. This carton configuration, as seen in FIG. 4C has the carton telescoped with the major flaps 23 and 25 in horizontal position. This is done since frequently the cartons are filled with items such as meat which may extend above the plane of the top edges of the carton making it difficult to seal the top closure flaps so that a clean rectangular carton results. In this method the carton flaps are closed with the sleeve 10 telescoped and then forced down onto the tray 11 so that the meat is pushed down into the container tray 11. Coincidentally there is an adhesive applied to the sides of the tray 11 which will be covered by the sides of the sleeve so that once the closure flaps are in position and the sleeve 10 is forced down over the tray 11 the clean rectangular shape will be retained since the sleeve 10 and tray 11 are glued together.

Figure 15:
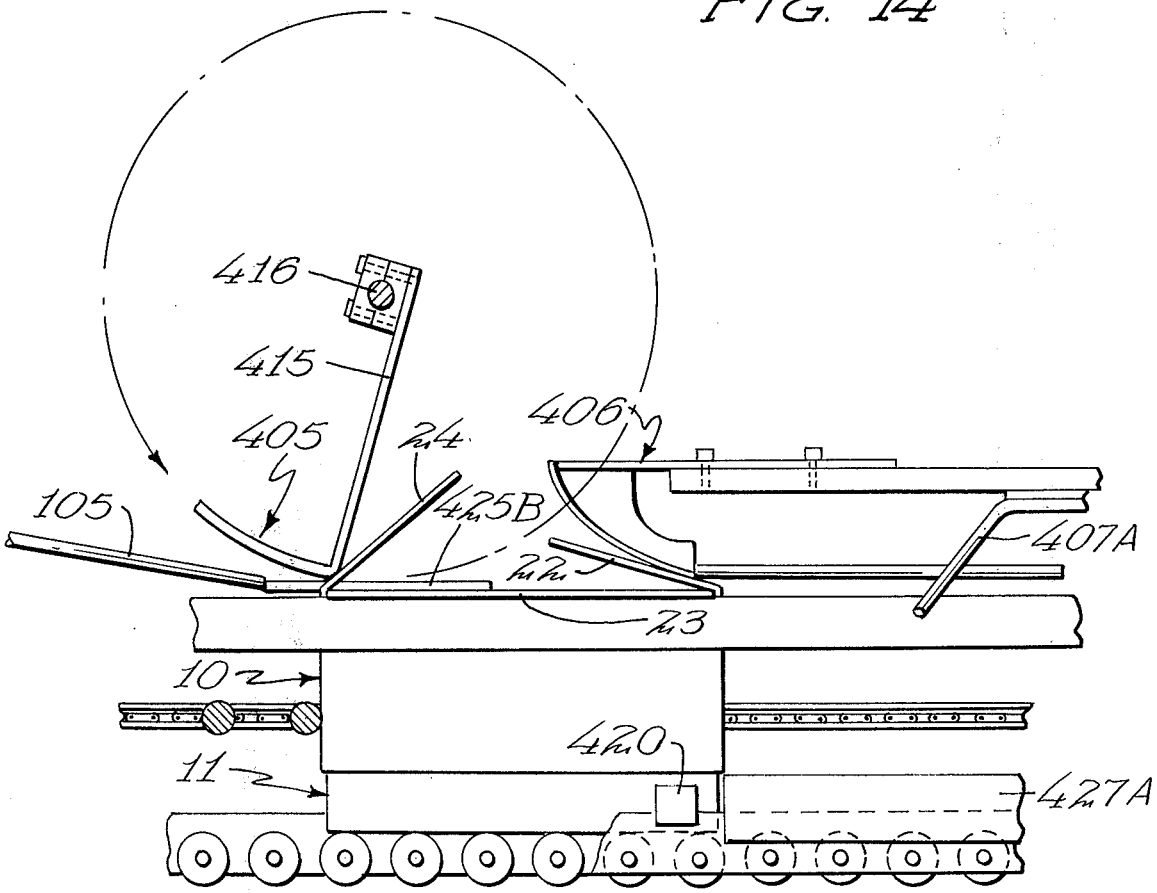
FIG. 15 illustrates the container shown in FIG. 14 in a subsequent operational phase of the apparatus which illustrates how the minor flaps are automatically folded and also illustrating the positioning of the glue applicator at the bottom of tray.

The conveyor 402 includes individual freely rotating conveyor rollers 403 which are attached to horizontal frame members 101 and are not driven since the container is advanced across them by the conveyor means 200. The minor flaps 22 and 24 must be folded into position first and this is accomplished for the leading flap, shown generally as 22 in the drawings, by a stationary fixed curved plow or cam member 406 which simply pushes the flap 22 down as seen best in FIG. 15. The trailing flap 24 must likewise be moved downwardly and that is accomplished by a counter-clockwise rotating plow means 405, the movement of which is synchronized with the advancing chain and spacer bars 202 and engages the rear flap 24 as seen in FIG. 15. FIG. 11 illustrates the means by which this mechanism is operated and includes a gear 408 which is attached to the opposite end of the drive shaft 210 which rotates clockwise along with the drive chain sprockets 211 and operates to engage a second gear 409 which rotates counter-clockwise and turns a sprocket wheel 410 which in turn moves a drive chain 411 directed by means of three additional sprocket wheels 412, 413 and 414 to rotate in counter-clockwise direction the arm 415 about the shaft 416 as seen in the drawings. This synchronous motion is obtained through the positive interaction of the gears driving both the conveyor 200 and the plow 405.

Figure 14:
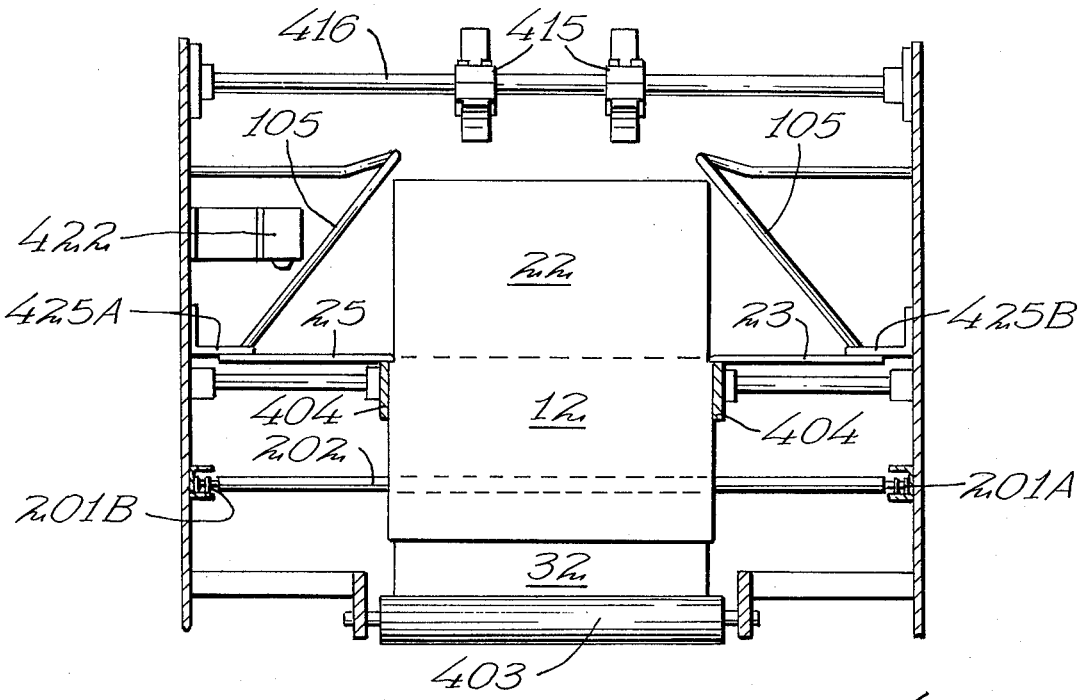
FIG. 14 is an elevation view of the container taken along section lines 14—14 in FIG. 5 in the configuration shown in FIG. 13 showing the front end as the container advances through the mechanism.
Figure 16:
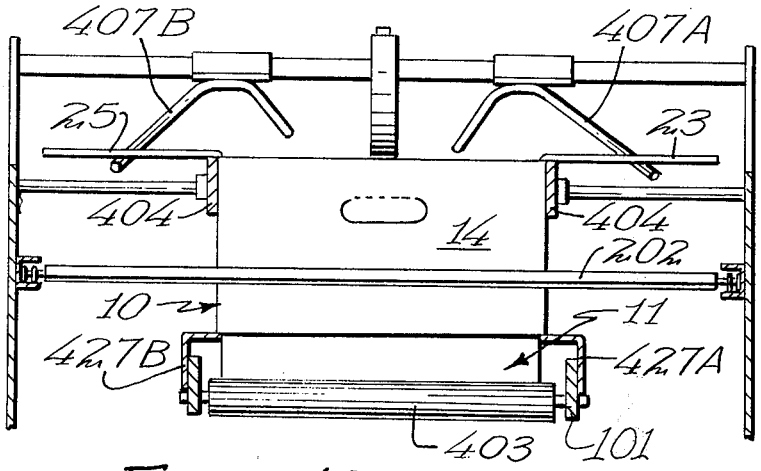
FIG. 16 is an end elevation view of the trailing end of the carton of FIG. 15 immediately following the automatic closure of the minor flaps just prior to the automatic closing of the major flaps by cam rails as the carton is advanced through the apparatus, taken along section lines 16—16 in FIG. 5.
Figure 17:
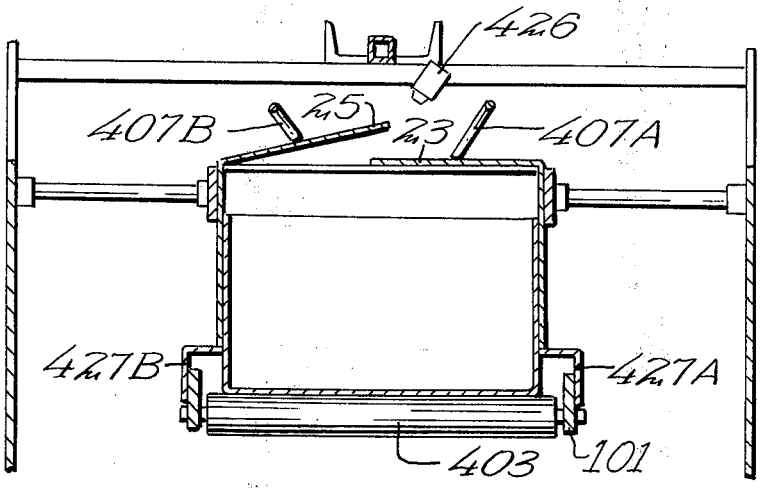
FIG. 17 is a transverse section view through the carton just prior to final closing of the major flaps as seen approximately in section 17—17 of FIG. 5 illustrating the positioning of the major flaps at the time the adhesive is applied.
Figure 18:
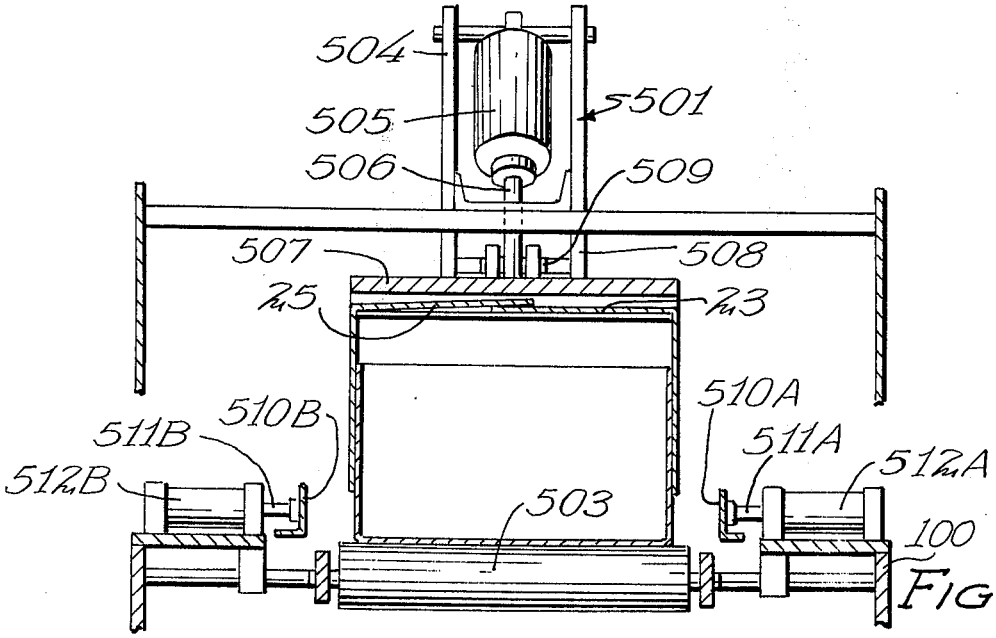
FIG. 18 is an end elevation view of the carton in the compression section shown in FIG. 19, taken along section lines 18—18 in FIG. 5.

After the carton sleeve 10 and tray 11 are telescoped apart and coincidentally with the folding of the minor flaps, adhesive is applied to the bottom side edges of the tray 11 which are exposed as seen in FIG. 4D where the adhesive appears as a stippled area 50. The glue is applied by applicators as can be seen in FIG. 15 which are designated as 420 and as can be seen in FIG. 5 also as 421. These glue applicators are activated by the passing of the container through the use of limit switch systems which are not shown. In addition, glue is applied as seen in FIG. 14 by a third applicator 422 to the upward facing surface of the major flap 23 which is being held in position not only the guide rail 404 but also by additional guiding edges 425A and 425B. This adhesive comes into contact with the top surfaces of the first folded minor flaps 22 and 24 and the major flaps 23 and 25 are then moved over and into position in overlapping relationship by the guide bars or plows 407A and 407B which operate more or less opposite to those at the in-feed portion of the apparatus 105. The drawing in FIG. 16 shows the major flaps 23 and 25 about to be engaged by the plows 407A and 407B as seen from the in-feed end of the apparatus and FIG. 17 shows a fourth glue applicator 426 positioned to apply adhesive to the top of the first folded major flap 23 just prior to closing of the major flap 25. This adhesive can be seen in FIG. 4E as 52. The adhesive on the inner side of the major flap 23 as seen best in FIG. 4C as 51.

427A and B are secondary support rails used to retain the sleeve 10 in the raised position, as seen in FIGS. 16 and 17, until the flaps 23 and 25 are reverse folded with gluing on flap 23. The upper rails 404 also keep alignment.

Compression Section and Discharge

Figure 19:
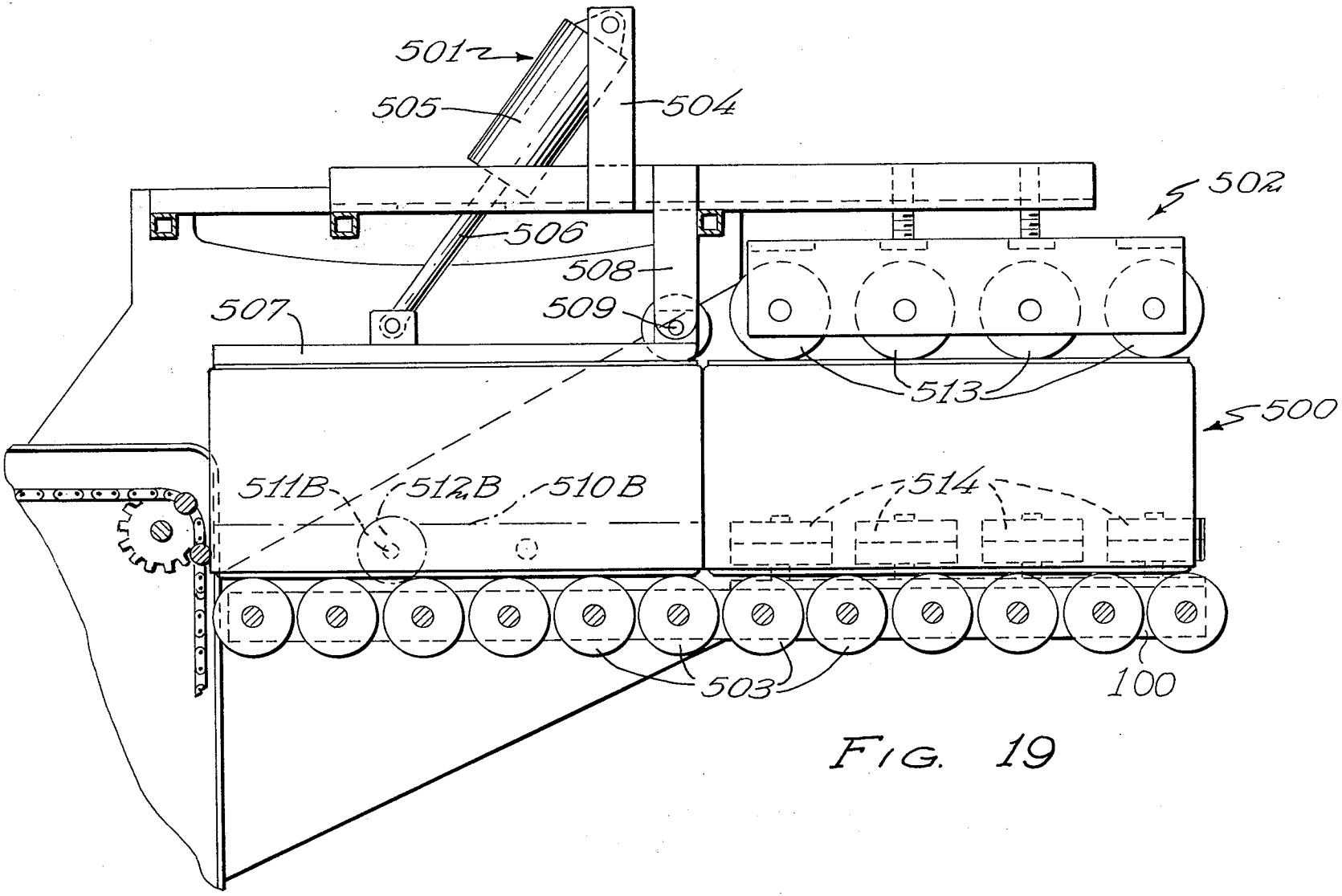
FIG. 19 is a side elevation view of a portion of the discharge end of the apparatus illustrating a carton in the compression section with the side pressure bars removed and the top compression means extended to force the top of the container down to its final position, along with a carton in the retention section just prior to discharge.
Figure 21:
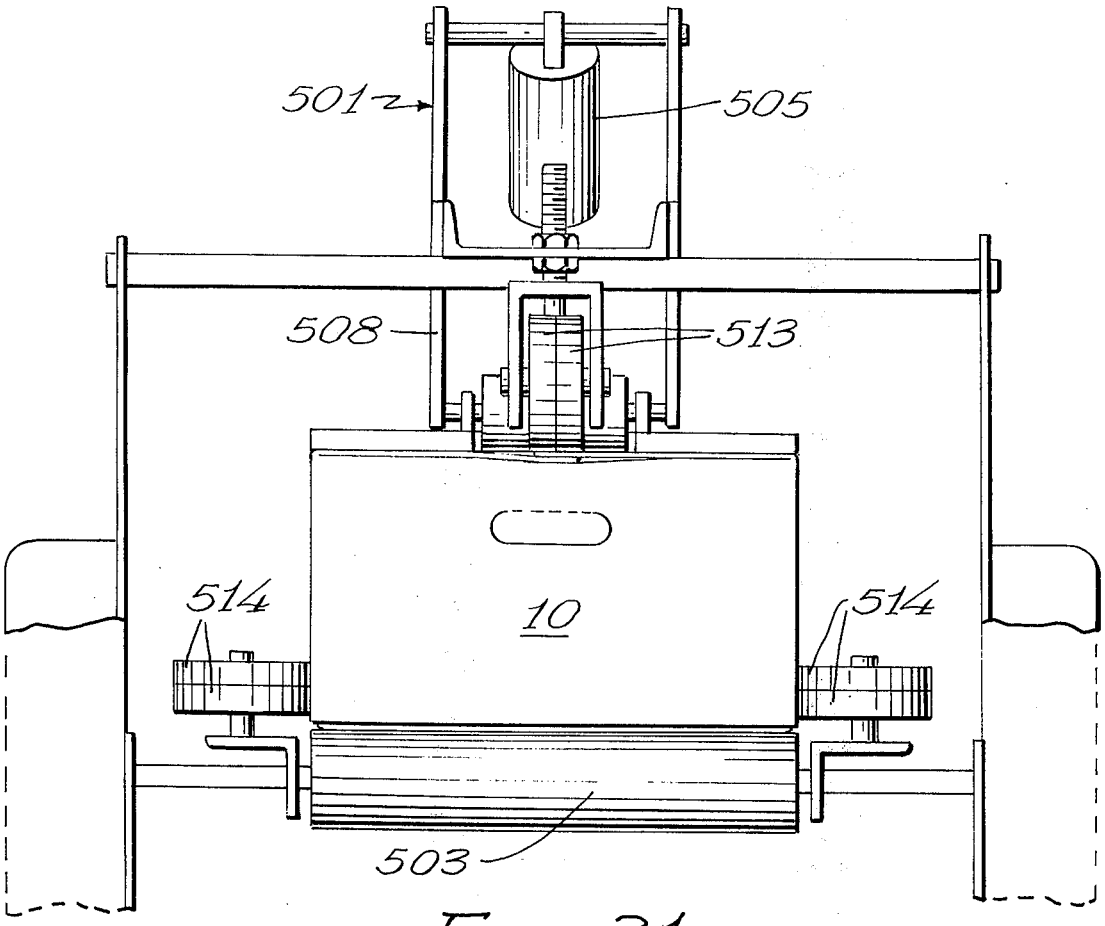
FIG. 21 is an end elevation of the leading end of the carton positioned in the restraining section of FIG. 19.
Figure 20:
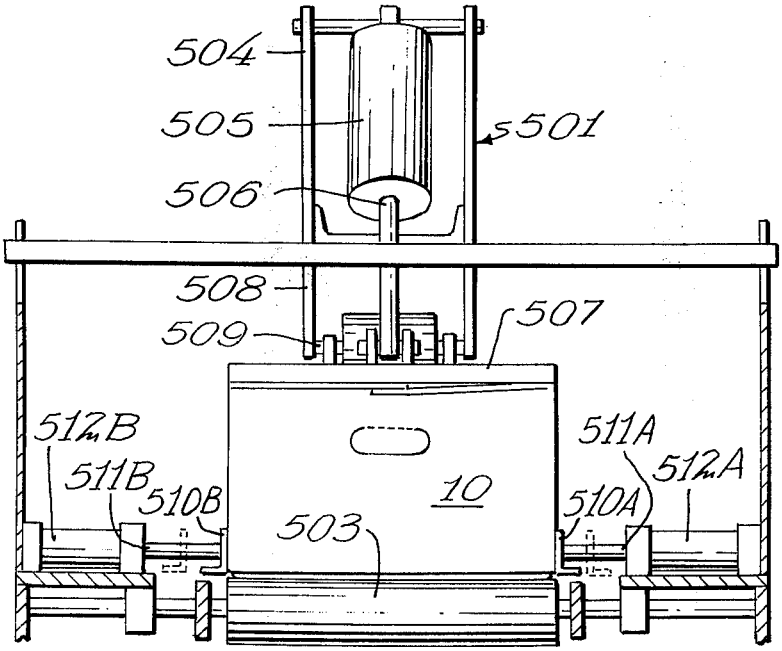
FIG. 20 is an end elevation view of the trailing end of the carton shown in the compression section as in FIG. 19 showing the top compression means engaged with the top of the container and the side compression bars securing the sleeve side walls to the tray.

The Compression and Discharge section 500 is supported by an extension of the frame assembly 100 and includes freely rotating conveyor rollers 503 on which the container moves, the container being pushed along by boxes which follow it out of the center section 400. The containers move initially into a compression section which is seen in FIG. 8 and includes top compression means 501 to force the sleeve 10, with the folded flaps in position and glued, down into proper alignment with the tray 11 and at the same time force the contents down below the level of the top of the tray. This top pressure means 501 includes a bracket 504 extending upwardly from the framework 100 to which is hingedly supported a fluid operated power cylinder 505 which serves to extend and retract a piston 506 which is hingedly attached to the top surface of the pressure plate 507 which contacts the entire top surface of the container. The opposite end of the pressure plate 507 is hingedly connected to a second mounting bracket 508 so that the plate rotates up and down about the pivot point 509 to hold the top of the sleeve 10 in position. In that same station are side mounted compression bars 510A and 510B which exert side pressure on the container to insure close contact between the outer walls of the sleeve 10 and the tray 11 to insure that the adhesive 50 placed along the bottom edges of the sides of the tray 11 sets properly. The pressure bars 510A and 510B are operated at the ends of piston rods 511A and 511B which are operated as part of the power cylinders 512A and 512B. These operate in unison with the upper pressure means 501 and the carton stays in this station until a following carton trips a limit switch, not shown, which releases the upper and side pressure means 501 and 512 to allow the container to be pushed on into the restraining section 500. FIG. 19 shows in side elevation view the relative position of two adjacent containers, with the upper pressure means 501 activated and a carton in the restraining section 500 just prior to discharge. The restraining section 500 includes large top rollers 513 which are mounted for free rotation in a portion of the frame 100 and serve simply to hold the top flaps in position while the glue more completely sets and has similar shaped side mounted pressure rollers 514 which engage the sides of the carton near the glue location and hold the sleeve and tray together until the adhesive sets. The container in this position is pushed out to a discharge chute or similar apparatus by trailing cartons.

I claim:

1. Apparatus for closing and sealing the flaps of and gluing together containers which are of the type assembled from a slotted tray with no top closure flaps and an outer sleeve which telescopes over the erected tray, which outer sleeve has top flaps hingedly attached thereto and foldable into position to form the top closure for the container, wherein said tray is erected and said sleeve is positioned thereon and the contents for the carton are loaded into said tray prior to being placed in said apparatus for sealing, said top closure flaps including major flaps on either lateral side of said container as it is presented to said apparatus and minor closure flaps on both the leading and trailing edges of said container as it is inserted into said apparatus comprising:

a frame supporting said apparatus;

an in-feed conveyor positioned at one end of said apparatus onto which said container may be located, said conveyor adapted to move said container into said apparatus and having positioned above said conveyor first cam rail means for engaging said major top closure flaps on either lateral edge of said container and rotate them outwardly and downwardly into a horizontal position as said container moves along said in-feed conveyor;

means mounted on said frame and positioned along the sides of said conveyor for orienting said container as it moves along said conveyor to properly position said container for entry into said apparatus;

a center section including a stepped support conveyor of freely rotatable rollers having a first section at the same elevation as said in-feed conveyor and a second section positioned vertically lower than said first section;

means for advancing said containers through said center section at spaced intervals including a pair of chains driven in unison positioned on either side of said center section with pairs of bars extending laterally between said pair of chains adapted to contact the trailing edge of said container and push it through said center section;

means driving said pair of chains in unison and means for directing said pairs of chains substantially horizontally above the surface of said stepped conveyor in said center section;

means for restraining said containers at the end of said in-feed conveyor, said restraining means automatically disengagable by the passing of said bars on said means for advancing containers as said bars are directed past said restraining means, said restraining means being positioned at the discharge end of said in-feed conveyor and near the point at which said containers are moved into said center section;

means positioned above said center section to engage the outwardly folded lateral major closure flaps of said container and support said outer sleeve in a vertical plane so that when said container is moved onto said lower conveyor section said sleeve and said tray are telescoped apart a predetermined distance;

fixed means for moving the minor closure flap on the leading edge of said container down into position on the top of said sleeve;

rotating plow means positioned above said center section and adapted to rotate downwardly and in the direction of the movement of said container in synchronous motion with the passing of said container to fold said trailing closure flap on said container down into position;

means for synchronizing the movement of said bars on said means for advancing said containers through said center section and said rotating plow means to insure that said rotating plow means operates in unison with the passing of each of said containers;

means positioned along said center section for sensing the presence of and applying adhesive to the outer lateral sides of said tray after said tray and said sleeve have been telescoped apart;

second plow means positioned above said center section and near the discharge end thereof adapted to engage and fold inwardly the lateral major closure flaps on said sleeve and completely fold them down into horizontal position juxtaposed with the top surface of said leading and trailing minor closure flaps on said container;

means for sensing and applying adhesive to said container closure flaps to hold said major flaps in position against said minor flaps;

a compression section mounted on said frame at the discharge end of said center section, including a series of horizontally positioned freely rotatable rollers to form a support conveyor in said compression section along with top compression means for forcing said sleeve downwardly into position over said tray;

side compression means for exerting force on the sides of said sleeve to enhance the setting of said adhesive and thereby sealing said sleeve to said tray;

said top compression means and side compression means operable in unison and controlled by means for sensing the presence of said container in said compression section together with means for sensing an approaching container in said center section in order to retract said top compression and said side compression means; and a retention and discharge section comprising rollers mounted at predetermined distances above said container as well as along the sides of said container to hold said top flaps and said sleeve and tray together to insure proper setting of said adhesive prior to removal from said apparatus, said containers moveable into said section by contact with subsequent containers being discharged from said center section.

2. The apparatus of claim 1, wherein said means for driving said chains in unison includes a motor connected to a rotatable shaft extending across the width of said apparatus having sprocket wheels attached thereto driving said pair of chains.

3. The apparatus of claim 2, wherein said synchronizing means comprises a geared wheel on said rotatable shaft coacting with a second geared wheel mounted on a second shaft, thereby generating a counter-rotation in said shaft, and a sprocket wheel also attached to said second shaft driving a chain extending to and driving in a counter rotating direction a sprocket wheel and attached shaft which are connected to said rotating plow means.

4. The apparatus of claim 1, wherein said restraining means comprises a gate arm extending above the plane of said in-feed conveyor and mounted on a sleeve for rotation about a shaft at the discharge end of said in-feed conveyor, said gate arm biased into position above said conveyor but rotatable downwardly below said plane, means positioned in the path of said spacer bars for rotating said gate arm out of the plane of said conveyor when said spacer bars pass that portion of said apparatus.

* * * * *